US010045127B2

(12) United States Patent
Kim et al.

(10) Patent No.: US 10,045,127 B2
(45) Date of Patent: Aug. 7, 2018

(54) ELECTRONIC DEVICE WITH MICRO SPEAKER

(71) Applicant: Samsung Electronics Co., Ltd., Gyeonggi-do (KR)

(72) Inventors: Ki Won Kim, Gyeonggi-do (KR); Byoung Hee Lee, Seoul (KR); Chang Shik Yoon, Seoul (KR); Ho Chul Hwang, Seoul (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/927,985

(22) Filed: Oct. 30, 2015

(65) Prior Publication Data

US 2016/0127834 A1 May 5, 2016

(30) Foreign Application Priority Data

Oct. 31, 2014 (KR) ..... 10-2014-0150738

(51) Int. Cl.

| | |
|---|---|
| ***H04R 25/00*** | (2006.01) |
| ***H04R 9/06*** | (2006.01) |
| ***H04R 7/04*** | (2006.01) |

(52) U.S. Cl.

CPC ..... *H04R 9/06* (2013.01); *H04R 7/04* (2013.01); *H04R 2209/027* (2013.01); *H04R 2499/11* (2013.01)

(58) Field of Classification Search

CPC ..... H04R 9/025; H04R 9/027; H04R 9/06; H04R 2209/022; H04R 2209/021; H04R 31/00; H04R 9/02; H04R 9/00; H04R 2201/003

USPC ..... 381/412, 433, 420, 386, 151; 181/172, 181/171

See application file for complete search history.

(56) References Cited

U.S. PATENT DOCUMENTS

| | | | | |
|---|---|---|---|---|
| 5,111,510 | A * | 5/1992 | Mitobe | H04R 7/16 181/172 |
| 2009/0180648 | A1* | 7/2009 | Endo | H04R 1/24 381/184 |
| 2009/0285417 | A1* | 11/2009 | Shin | H04M 1/03 381/151 |
| 2013/0051597 | A1 | 2/2013 | Yeom | |
| 2013/0195293 | A1* | 8/2013 | Ko | H04R 19/02 381/191 |
| 2014/0241564 | A1* | 8/2014 | Kang | H04R 7/045 381/386 |

* cited by examiner

*Primary Examiner* — Davetta W Goins
*Assistant Examiner* — Phylesha Dabney
(74) *Attorney, Agent, or Firm* — Cha & Reiter, LLC.

(57) ABSTRACT

A micro speaker is provided. The micro speaker includes a diaphragm, at least one coil coupled with the diaphragm, a magnet configured to interact with a magnetic field induced by the at least one coil, and a yoke plate located on a bottom of the magnet to support the magnet and including a hole therein, top and bottom ends of the hole being opened. An area, adjacent to the hole, of a lower surface of the yoke plate has a height difference relative to another area of the lower surface of the yoke plate.

5 Claims, 9 Drawing Sheets

ELECTRONIC DEVICE WITH MICRO SPEAKER

CLAIM OF PRIORITY

This application claims priority from and benefit under 35 U.S.C. § 119(a) from a Korean patent application filed on Oct. 31, 2014 in the Korean Intellectual Property Office and assigned Serial number 10-2014-0150738, and which is incorporated herein by reference in its entirety.

TECHNICAL FIELD

The present disclosure relates to an electronic device which includes a micro speaker.

BACKGROUND

Electronic devices such as a smartphone, a tablet, and the like provide a user with various sounds through a sound output function. Being miniaturized and highly integrated, electronic devices use a micro speaker unit for sound output.

A conventional speaker operates in a manner where sounds (hereinafter respectively referred to as "forward and backward sounds") are emitted forward and backward with a diaphragm in the center. For example, a speaker mounted on a smartphone transmits the forward sound to a user as an output, and the backward sound is processed at an internal space of an electronic device. However, as smartphones are becoming thinner, these electronic device which includes a conventional micro speaker does not sufficiently secure space through which the backward sound can be emitted, thereby lowering the performance of a sound appliance.

SUMMARY

The current disclosure addresses at least the above-mentioned problems and/or disadvantages and provides additional advantages described below.

Accordingly, an aspect of the present disclosure is to provide a micro speaker configured to secure a space around a hole of a micro speaker through a stepped structure, thereby improving performance and durability.

According to an aspect of the present disclosure, a micro speaker may include a diaphragm, at least one coil coupled with the diaphragm, a magnet configured to interact with a magnetic field induced by the at least one coil, and a yoke plate located on a bottom of the magnet to support the magnet and includes a hole therein, top and bottom ends of the hole being opened. An area, adjacent to the hole, of a lower surface of the yoke plate has a height difference relative to another area of the lower surface of the yoke plate.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
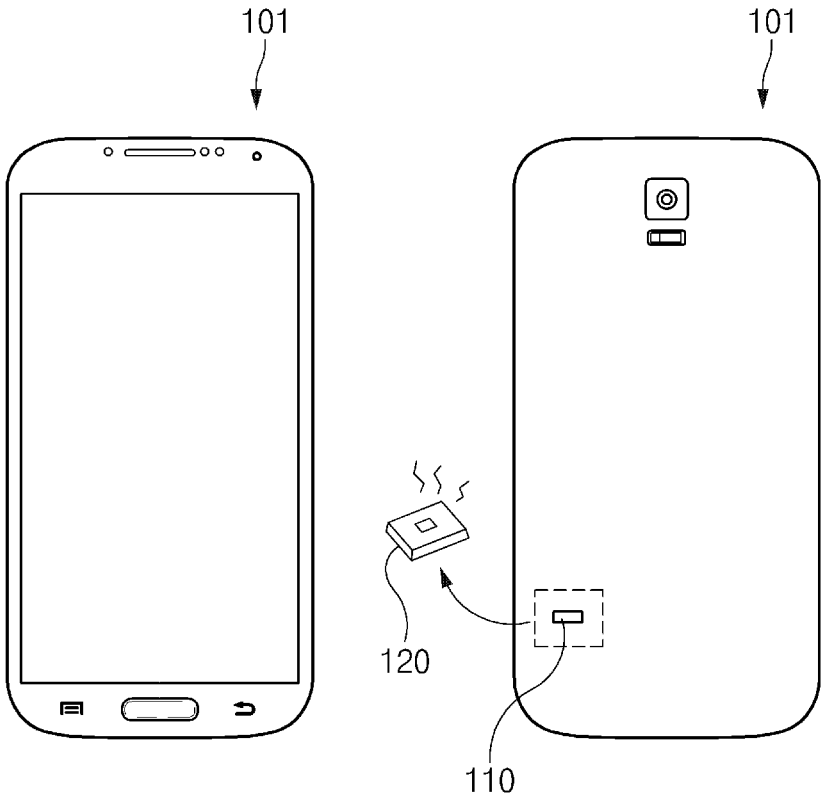
FIG. 1 is a structure diagram of an electronic device according to various embodiments of the present disclosure.

Various embodiments of the present disclosure may be described with reference to accompanying drawings. Accordingly, those of ordinary skill in the art will recognize that modification, equivalent, and/or alternative on the various embodiments described herein can be variously made without departing from the scope and spirit of the present disclosure. With regard to description of drawings, similar components may be marked by similar reference numerals.

In the disclosure disclosed herein, the expressions "have," "may have," "include" and "comprise," or "may include" and "may comprise" used herein indicate existence of corresponding features (e.g., elements such as numeric values, functions, operations, or components) but do not exclude presence of additional features.

In the disclosure disclosed herein, the expressions "A or B," "at least one of A or/and B," or "one or more of A or/and B," and the like used herein may include any and all combinations of one or more of the associated listed items. For example, the term "A or B," "at least one of A and B," or "at least one of A or B" may refer to all of the case (1) where at least one A is included, the case (2) where at least one B is included, or the case (3) where both of at least one A and at least one B are included.

The terms, such as "first," "second", and the like used herein may refer to various elements of various embodiments of the present disclosure, but do not limit the elements. For example, such terms do not limit the order and/or priority of the elements. Furthermore, such terms may be used to distinguish one element from another element. For example, "a first user device" and "a second user device" indicate different user devices. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it can be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used as, for example, the expression "suitable for," "having the capacity to," "designed to," "adapted to," "made to," or "capable of" The term "configured to" must not mean only "specifically designed to" in hardware. Instead, the expression "a device configured to" may mean that the device is "capable of" operating together with another device or other components. For example, a "processor configured to perform A, B, and C" may mean a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in this specification are used to describe specified embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

An electronic device according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, wearable devices (e.g., head-mounted-devices (HMDs), such as electronic glasses), an electronic apparel, electronic bracelets, electronic necklaces, electronic appcessories, electronic tattoos, smart mirrors, smart bands, smart watches, and the like.

Hereinafter, electronic devices according to an embodiment of the present disclosure will be described with reference to the accompanying drawings. The term "user" used herein may refer to a person who uses an electronic device or may refer to a device (e.g., an artificial electronic device) that uses an electronic device.

FIG. 1 is a structure diagram of an electronic device according to various embodiments of the present disclosure.

Referring to FIG. 1, an electronic device 101 may include various components such as a display, a camera module, a button, and the like thereon. The electronic device 101 may further include a sound output part 110 for performing a sound output function. The sound output part 110 may output various sounds which are generated according to an operation of the electronic device 101. For example, the sound output part 110 may output music during reproduction of a sound source or may output a sound signal during reproduction of a video. According to various embodiments of the present disclosure, the sound output part 110 may output a telephone conversation sound (e.g., a voice of another party) if telephone conversation is made in a speaker mode.

In FIG. 1, an embodiment of the inventive concept is exemplified as the sound output part 110 is disposed on a back side (a surface opposite to a surface on which a display is disposed) of the electronic device 101. However, the scope and spirit of the present disclosure may not be limited thereto. For example, the sound output part 110 may be disposed on a front side, a left/right side, a top/bottom side, or the like.

A sound output module 120 may be mounted in a case in which the sound output part 110 is formed. The sound output module 120 may be mounted on a housing or a circuit board in the electronic device 101. The sound output module 120 may receive an electric signal from an internal circuit of the electronic device 101 and may output a sound through the sound output part 110. For example, the sound output module 120 may convert an electric signal into physical vibration of a diaphragm.

According to various embodiments of the present disclosure, the sound output module 120 may include a micro speaker and an enclosure for protecting and supporting the micro speaker. The enclosure may be formed to surround the micro speaker and may be used to mount and electrically connect the sound output module 120 on and with a circuit board of the electronic device 101.

As an electronic device is miniaturized, a space for disposing the sound output module 120 in the electronic device 101 may become narrower, and thus, various parts or elements constituting the sound output module 120 and a space among components may become narrower. According to various embodiments of the present disclosure, the sound output module 120 may include a component having a stepped structure to compensate for output performance degradation. The stepped structure may be formed at a portion from which a backward sound opposite to a forward sound reproduced from a micro speaker is outputted and may improve resonance performance. Furthermore, the stepped structure may make emission of heat easy, and thus, durability of a device may be improved. Additional information about the stepped structure will be given with reference to FIGS. 3 to 7.

Figure 2:
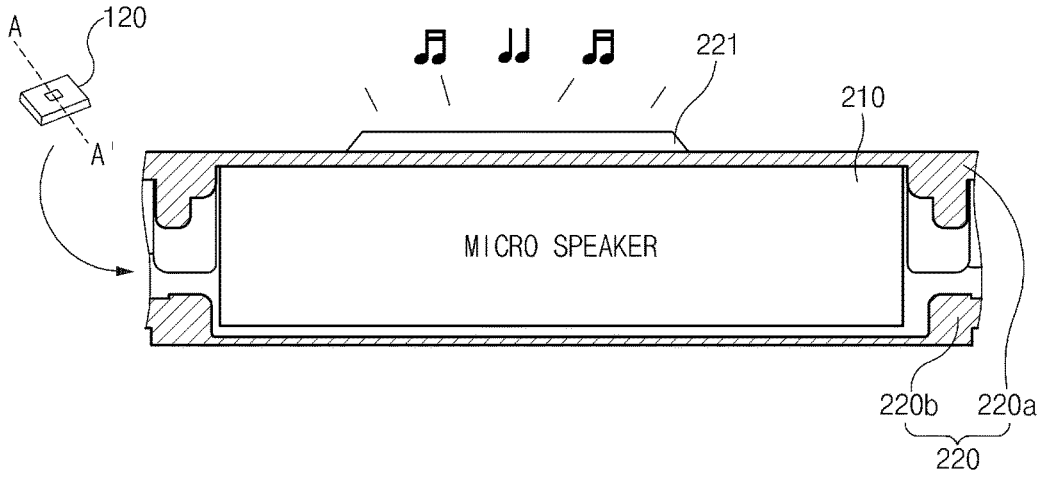
FIG. 2 is a cross-sectional view of a sound output module according to various embodiments of the present disclosure.

FIG. 2 is a cross-sectional view of a sound output module according to various embodiments of the present disclosure.

Referring to FIG. 2, the sound output module 120 may receive an electric signal from an internal circuit (e.g., a printed circuit board (PCT), a flexible PCB (FPCB), or the like) of the electronic device 101 and, for example, may convert the received electric signal into physical vibration. According to various embodiments of the present disclosure, the sound output module 120 may include a micro speaker 210 and an enclosure 220.

The micro speaker 210 may convert an electric signal into physical vibration (e.g., vibration of air due to vibration of a diaphragm) and may convert the physical vibration into a sound that a user can hear. The micro speaker 210 may include a diaphragm, a coil, a magnet, and the like. The micro speaker 210 may transfer an electric signal (e.g., a current) to the coil, and thus, the diaphragm coupled with, or connected with, the coil may vibrate according to interaction (e.g., a magnetic force changed according to a direction of a current) between a magnetic field generated from the coil and a magnetic field of a magnet (e.g., a permanent magnet). Air around the diaphragm may vibrate due to the vibration of the diaphragm. The vibration of air generated on a front side of the diaphragm (e.g., a side facing the sound output part 110) may make it possible to output a sound that a user can hear. The micro speaker 210 may include a hole for outputting a backward sound generated toward a back side of the diaphragm. A gap or an air layer larger than a specific space may be formed at a periphery of the hole to secure resonance of the backward sound outputted through the hole. According to various embodiments of the present disclosure, the micro speaker 210 may have a stepped structure or may include a part having a stepped structure. A gap or an air layer may be formed around the hole through the stepped structure. A structure and the stepped structure of the micro speaker 210 will be in detail described with reference to FIG. 3.

The enclosure 220 may be formed to surround the micro speaker 210. The enclosure 220 may protect and support the micro speaker 210. According to various embodiments of the present disclosure, the enclosure 220 may include an upper enclosure 220*a* and a lower enclosure 220*b*. The upper enclosure 220*a* and the lower enclosure 220*b* may be independently manufactured and may be then coupled with each other. The upper enclosure 220*a* and the lower enclosure 220*b* may be coupled with each other after mounting the micro speaker 210 therein, in the process of manufacturing the sound output module 120.

The upper enclosure 220*a* may include an output unit 221 for outputting a sound generated from the micro speaker 210. The output unit 221 may be disposed to be adjacent to the sound output part 110 in the electronic device 101 and may provide a sound signal to a user. According to various embodiments of the present disclosure, the sound output part 110 of the electronic device 101 may be an opening, and the output unit 221 may be exposed through the opening. The output unit 211 or the sound output part 110 may have a mesh structure.

The lower enclosure 220*b* may support and fix the micro speaker 210. The lower enclosure 220*b* may define a gap or an air layer for securing resonance of a backward sound generated from a lower end of the micro speaker 210. According to various embodiments of the present disclosure, the lower enclosure 220*b* may have a stepped structure to define the gap or the air layer. The stepped structure formed at the lower enclosure 220*b* will be described in detail with reference to FIG. 5 or 6.

Figure 3:
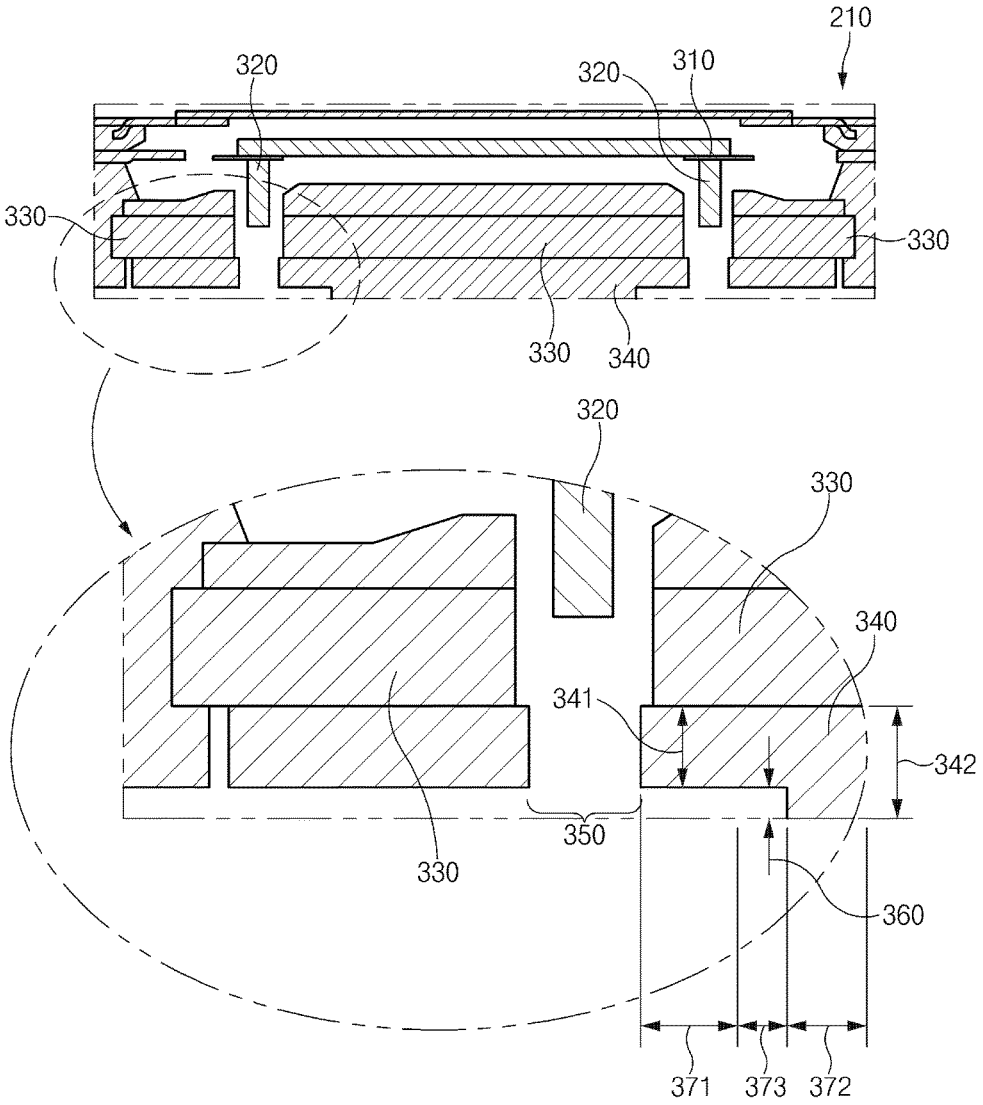
FIG. 3 is a cross-sectional view of a micro speaker according to various embodiments of the present disclosure.

FIG. 3 is a cross-sectional view of a micro speaker according to various embodiments of the present disclosure.

Referring to FIG. 3, the micro speaker 210 may include a diaphragm 310, a coil 320, a magnet 330, and a yoke plate 340.

The diaphragm 310 may create a sound according to vibration of the coil 320. The diaphragm 310 may be implemented with one plate or a plurality of plates. A user may hear a sound generated from the diaphragm 310.

The coil 320 may vibrate through interaction with a magnetic field of the magnet 330 according to an electric signal. The vibration generated from the coil 320 may be transferred to the diaphragm 310 so as to be converted into a sound. According to various embodiments of the present disclosure, the coil 320 may be provided in plurality.

The magnet 330 may generate a magnetic field around the coil 320. The magnet 330 may be disposed to surround at least a part of the coil 320 and to have magnetic polarities which are contrary to each other with the coil 320 as the center. The coil 320 may vibrate according to interaction between a magnetic field generated by the magnet 330 and a magnetic field induced by the coil 320.

The yoke plate 340 may be located on the bottom of the magnet 330 to support the magnet 330. The yoke plate 340 may include at least one hole 350 of which the bottom and top ends are opened. The hole 350 may be disposed to be adjacent to the coil 320.

The hole 350 may discharge heat or a backward sound generated when the coil 320 vibrates. An enough space (a space for resonance and heat emission) around the hole 350 may enable the micro speaker 210 to output a backward sound smoothly or discharge heat efficiently. The space may be defined by changing a thickness of the yoke plate 340 or a thickness of a supporting structure (e.g., the lower enclosure of FIG. 2) disposed under the yoke plate 340.

According to various embodiments of the present disclosure, the yoke plate 340 may be formed with a structure in which an area adjacent to the hole 350 has a height difference relative to another area (e.g., a stepped structure), on a lower surface thereof. A space for resonance of a backward sound and heat emission may be defined around the hole 350 based on the height difference.

According to various embodiments of the present disclosure, the yoke plate 340 may have a first thickness 341 at a first area 371 adjacent to the hole 350. The yoke plate 340 may have a second thickness 342 thicker than the first thickness 341 at a second area 372 getting out of the first area 371. The yoke plate 340 may have a thickness, which varies between the first thickness 341 and the second thickness 342, at a third area 373 between the first area 371 and the second area 372.

A space (or a gap) 360 may be defined by a change in a thickness of the yoke plate 340. The space 360 may enable a backward sound to resonate and heat generated in the micro speaker 210 to be emitted.

According to various embodiments of the present disclosure, the yoke plate 340 may change continuously or discontinuously at the third area 373. For example, the yoke plate 340, as illustrated in FIG. 3, may be formed to have a discontinuously stepped structure (e.g., such that a thickness of the yoke plate 340 is changed from the first thickness 341 to the second thickness 342 in the shape of a vertical stairway).

However, the scope and spirit of the present disclosure may not be limited thereto. For example, the yoke plate 340 may be continuously changed, or variable from the first thickness 341 to the second thickness 342 along an inclined plane, at the third area 373.

According to various embodiments of the present disclosure, the electronic device 101 may maintain a gap separate from a supporting structure (e.g., the lower enclosure 220*b*) disposed under the yoke plate 340, thereby securing an additional space.

Figure 4A:
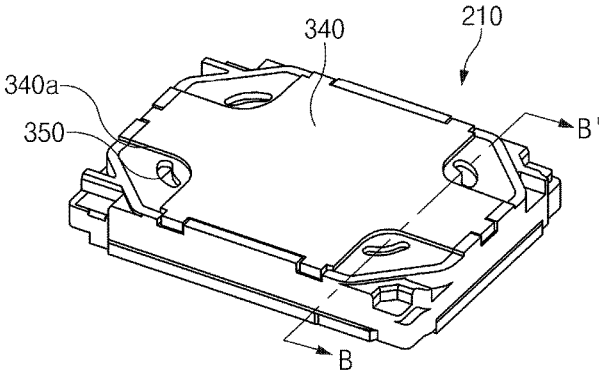
FIG. 4, FIG. 4B and FIG. 4C are rear perspective views and a partial cross-sectional views of a micro speaker according to various embodiments of the present disclosure.
Figure 4B:
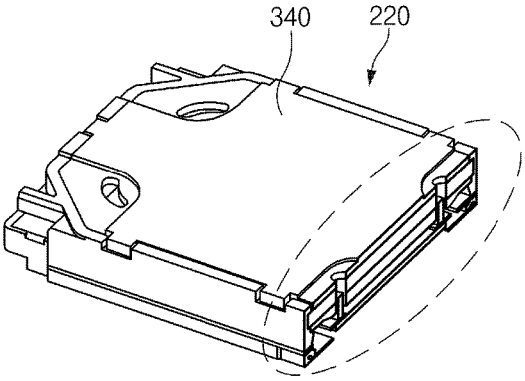
Figure 4C:
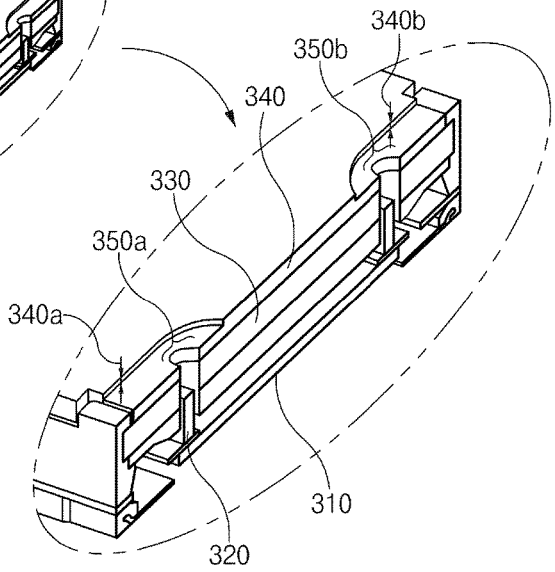

FIGS. 4A, 4B and 4C are rear perspective views and a partial cross-sectional view of a micro speaker shown in FIG. 4B, respectively, according to various embodiments of the present disclosure.

Referring to FIGS. 4A to 4C, the yoke plate 340 may be disposed on a back side of the micro speaker 210. The yoke plate 340 may include at least one hole 350 at the rear side thereof. A backward sound or heat generated in the micro speaker 210 may be emitted through the hole 350. In FIGS. 4A, 4B and 4C, an embodiment of the inventive concept is exemplified as four holes 350 are defined. However, the scope and spirit of the present disclosure may not be limited thereto.

As shown in FIG. 4A, a stepped structure 340*a* may be formed around the hole 350. The stepped structure 340*a* may be formed in the shape of surrounding at least a part of the hole 350. The stepped structure 340*a* may define a space around the hole 350 to enable a backward sound to resonate and heat to be emitted.

The yoke plate 340 may be formed to have a first thickness at an area adjacent to the hole 350 and to have a second thickness, thicker than the first thickness, at another area getting out of the area. In FIGS. 4A to 4C, an embodiment of the inventive concept is exemplified as the yoke plate 340 is vertically changed with one step. For example, the yoke plate 340 may be formed to have a plurality of steps or such that a thickness thereof changes continuously along an inclined plane around the stepped structure 340*a*. Referring to a cross-sectional view of the micro speaker 201 taken along a line B-B' in FIG. 4A, the micro speaker 210 may include a diaphragm 310, a coil 320, a magnet 330, and a yoke plate 340, as shown in FIG. 4C.

The yoke plate 340 may have a first thickness at a peripheral area surrounding the hole 350 and a second thickness, thicker than the first thickness, at another area far away from the hole 350. The yoke plate 340 may be formed to have a first thickness, which is relatively thin, for formation of a space around the hole 350 and to have a second thickness, which is relatively thick, at either a central portion of the yoke plate 340 or at least a part between holes (e.g., between first and second holes 350*a* and 350*b*).

Figure 5:
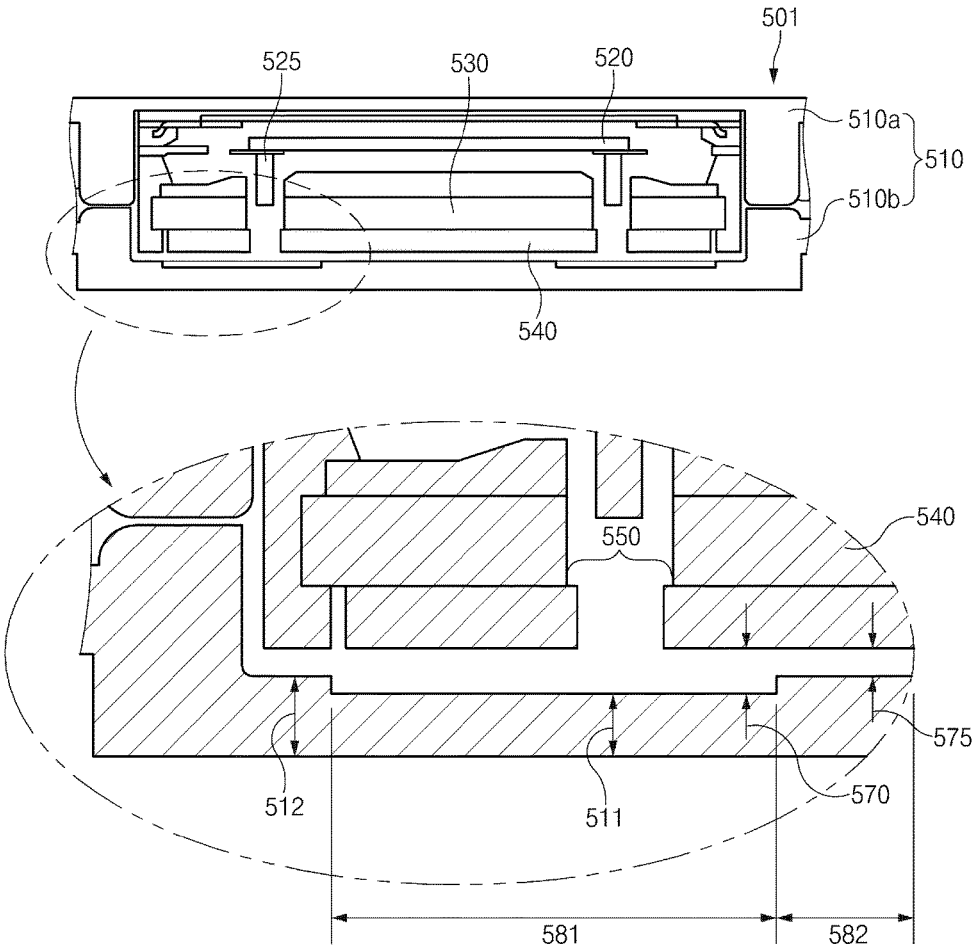
FIG. 5 is a cross-sectional view illustrating a stepped structure formed on a lower enclosure, according to various embodiments of the present disclosure.

FIG. 5 is a cross-sectional view illustrating a stepped structure formed on a lower enclosure, according to various embodiments of the present disclosure.

Referring to FIG. 5, a sound output module 501 may include an enclosure 510 (including an upper enclosure 510*a* and a lower enclosure 510*b*), a diaphragm 520, a coil 525, a magnet 530, and a yoke plate 540.

The yoke plate 540 may include at least one hole 550 of which the top and bottom ends are opened. The hole 550 may output a backward sound or heat. The hole 550 may be disposed to be adjacent to the coil 525.

According to various embodiments of the present disclosure, the lower enclosure 510*b* may be formed to have a structure (e.g., a stepped structure) in which an area adjacent to the hole 550 has a height difference relative to another area. A space for resonance of a backward sound and heat emission may be formed around the hole 550 based on the height difference.

According to various embodiments of the present disclosure, the lower enclosure 510*b* may have a first thickness 511 at a first area 581 adjacent to the hole 550. At a second area 582 getting out of the first area 581, the lower enclosure 510*b* may have a second thickness which is thicker than the first thickness 511. For example, a first height difference 570 may be defined at a first area 581 adjacent to the hole 550, and a second height difference 575 may be defined at a second area 582 getting out of the first area 581. The first height difference 570 may be larger than the second height difference 575.

According to various embodiments of the present disclosure, the lower surface of the yoke plate 540 may be flat. A sound processing module 501 may include the yoke plate 540 which is flat around the hole 550 without a thickness difference, and a backward sound or heat may be emitted through a space defined by a change in a thickness of the lower enclosure 510*b*.

Figure 6:
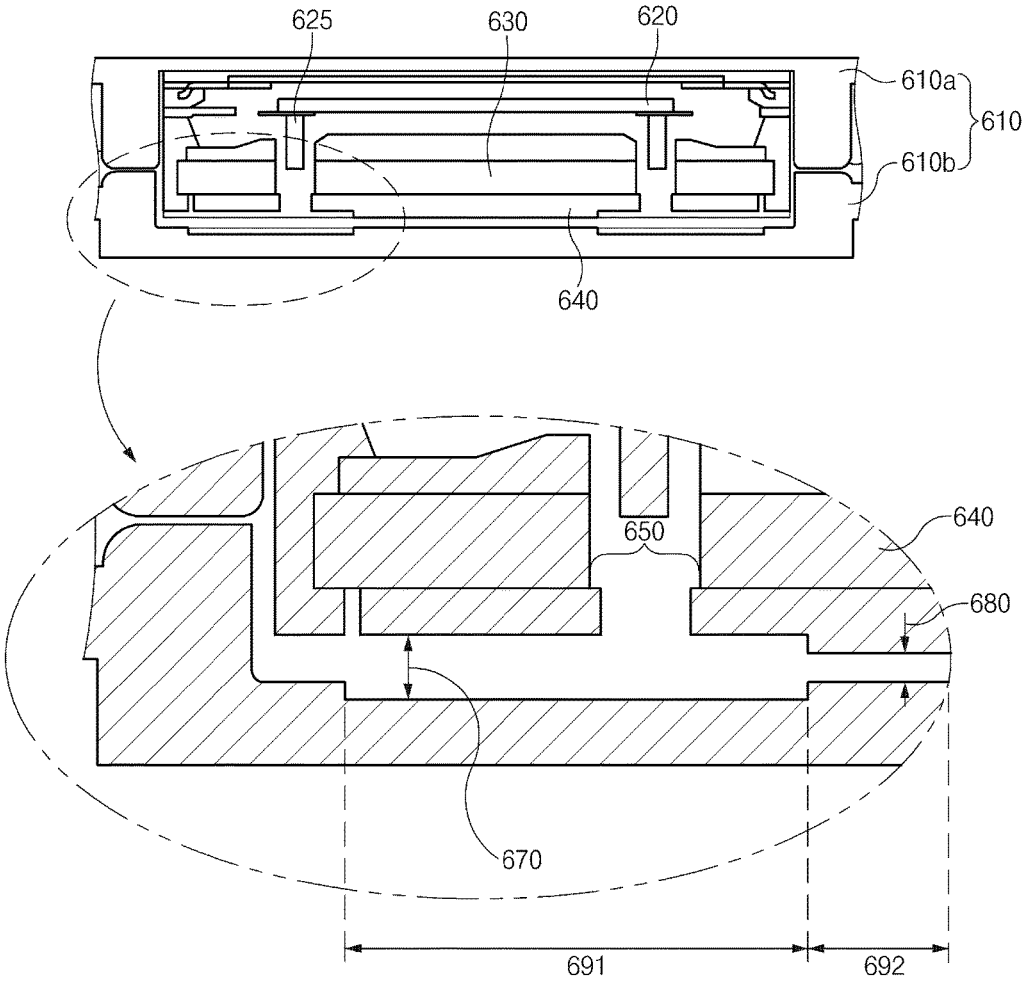
FIG. 6 is a cross-sectional view illustrating a thickness change of a yoke plate and an enclosure, according to various embodiments of the present disclosure.

FIG. 6 is a cross-sectional view illustrating thickness changes of a yoke plate and an enclosure, according to various embodiments of the present disclosure.

Referring to FIG. 6, a sound output module 601 may include an enclosure 610 (including an upper enclosure 610*a* and a lower enclosure 610*b*), a diaphragm 620, a coil 625, a magnet 630, and a yoke plate 640.

The yoke plate 640 may include at least one hole 650 of which the top and bottom ends are opened. The hole 650 may discharge a backward sound or heat. The hole 650 may be disposed to be adjacent to the coil 625.

According to various embodiments of the present disclosure, each of the yoke plate 640 and the lower enclosure 610*b* may be formed to have a stepped structure in an area adjacent to the hole 650. A space for resonance of a backward sound and heat emission may be formed around the hole 650 based on the height difference defined by thickness changes of the yoke plate 640 and the lower enclosure 610*b*.

Figure 7:
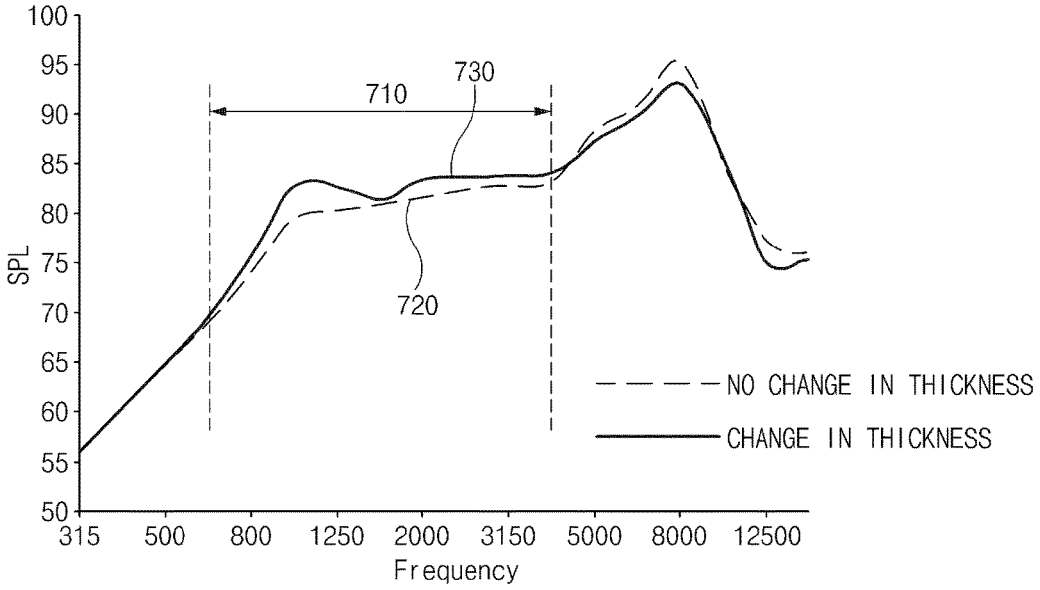
FIG. 7 is a graph schematically illustrating voltages before and after a thickness change of a yoke plate according to various embodiments of the present disclosure.

Thicknesses of the yoke plate 640 and the lower enclosure 610*b* all may decrease at a first area 691 adjacent to the hole 650, thereby defining a first height difference 670. The thicknesses of the yoke plate 640 and the lower enclosure 610*b* all may increase at a second area 692 getting out of the first area 691, thereby defining a second height difference 680. The first height difference 670 may be larger than the second height difference 680 and may be used as a space for discharging a backward sound or heat from the hole 650. FIG. 7 is a graph schematically illustrating voltages before and after a thickness change of a yoke plate according to various embodiments of the present disclosure.

Referring to FIG. 7, in the case where a thickness of a yoke plate is changed around a hole, a space sufficient to emit a backward sound may be secured around the hole. In the case where the backward sound is smoothly emitted through the space and the backward sound may not interfere with a forward sound, amplitude of the forward sound generated from a diaphragm may increase, thereby making the sound pressure higher.

In FIG. 7, in a specific output frequency range 710 (e.g., a range from 600 Hz to 4000 Hz), the sound pressure (graph 730) after a thickness change of a yoke plate may become higher than the sound pressure (graph 720) before a thickness change of the yoke plate. This may indicate that a thickness change of the yoke plate makes the sound pressure higher.

According to various embodiments of the present disclosure, in the case where a thickness of a yoke plate is changed around a hole, a space sufficient to emit heat to the outside may be secured, thereby improving durability of a device.

Figure 8:
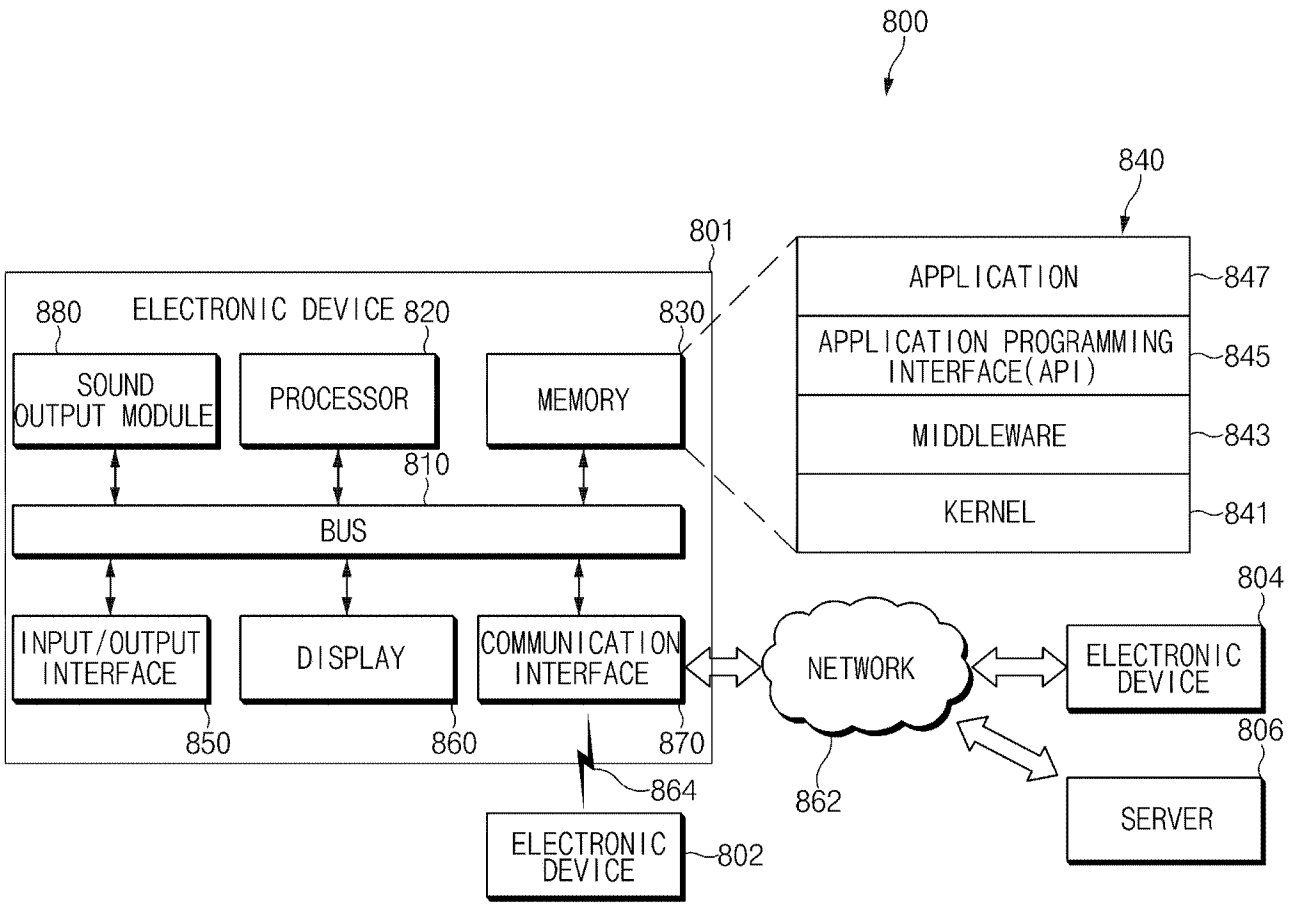
FIG. 8 is a diagram illustrating an electronic device in a network environment 800, according to various embodiments of the present disclosure.

FIG. 8 is a diagram illustrating an electronic device in a network environment, according to various embodiments of the present disclosure.

Referring to FIG. 8, there is illustrated an electronic device 801 in a network environment 800 according to various embodiments of the present disclosure. The electronic device 801 may include a bus 810, a processor 820, a memory 830, an input/output (I/O) interface 850, a display 860, a communication interface 870, and a sound output module 880. According to an embodiment of the present disclosure, the electronic device 801 may not include at least one of the above-described components or may further include other component(s).

The bus 810 may interconnect the above-described components 810 to 880 and may be a circuit for conveying communications (e.g., a control message and/or data) among the above-described components.

The processor 820 may include one or more of a central processing unit (CPU), an application processor (AP), or a communication processor (CP). The processor 820 may perform, for example, data processing or an operation associated with control or communication of at least one other component(s) of the electronic device 801.

The memory 830 may include a volatile and/or nonvolatile memory. The memory 830 may store instructions or data associated with at least one other component(s) of the electronic device 801.

According to various embodiments of the present disclosure, the memory 830 may store software and/or a program 840. The program 840 may include, for example, a kernel 841, a middleware 843, an application programming interface (API) 845, and/or an application program (or an application) 847. At least a portion of the kernel 841, the middleware 843, or the API 845 may be called an "operating system (OS)."

The kernel 841 may control or manage system resources (e.g., the bus 810, the processor 820, the memory 830, and the like) that are used to execute operations or functions of other programs (e.g., the middleware 843, the API 845, and the application program 847). Furthermore, the kernel 841 may provide an interface that allows the middleware 843, the API 845, or the application program 847 to access discrete components of the electronic device 801 so as to control or manage system resources. The middleware 843 may perform a mediation role such that the API 845 or the application program 847 communicates with the kernel 841 to exchange data.

The middleware 843 may perform a mediation role such that the API 845 and the application program 847 communicate with the kernel 841 to exchange data. Furthermore, the middleware 843 may process task requests received from the application program 847 according to a priority. For example, the middleware 843 may assign the priority, which makes it possible to use a system resource (e.g., the bus 810, the processor 820, the memory 830, or the like) of the electronic device 801, to at least one of the application program 847. For example, the middleware 843 may process the one or more task requests according to the priority assigned to the at least one, which makes it possible to perform scheduling or load balancing on the one or more task requests.

The API 845 may be an interface through which the application program 847 controls a function provided by the kernel 841 or the middleware 843, and may include, for example, at least one interface or function (e.g., an instruction) for a file control, a window control, image processing, a character control, or the like.

The I/O interface 850 may transmit an instruction or data, input from a user or another external device, to other component(s) of the electronic device 801. Furthermore, the I/O interface 850 may output an instruction or data, received from other component(s) of the electronic device 801, to a user or another external device.

The display 860 may include, for example, a liquid crystal display (LCD), a light-emitting diode (LED) display, an organic LED (OLED) display, or a microelectromechanical systems (MEMS) display, or an electronic paper display. The display 860 may display, for example, various contents (e.g., a text, an image, a video, an icon, a symbol, and the like) to a user. The display 860 may include a touch screen and may receive, for example, a touch, gesture, proximity, or hovering input using an electronic pen or a portion of a user's body.

The communication interface 870 may establish communication between the electronic device 801 and an external electronic device (e.g., a first external electronic device 802, a second external electronic device 804, or a server 806). For example, the communication interface 870 may be connected to a network 862 through wireless communication or wired communication to communicate with the external device (e.g., the second external electronic device 804 or the server 806).

The wireless communication may include at least one of, for example, LTE, LTE-A, CDMA, WCDMA, UMTs, WiBro, GSM, or the like, as cellular communication protocol. The wired communication may include at least one of, for example, a universal serial bus (USB), a high definition multimedia interface (HDMI), a recommended standard-832 (RS-832), or a plain old telephone service (POTS). The network 862 may include at least one of telecommunications networks, for example, a computer network (e.g., LAN or WAN), an internet, or a telephone network.

Each of the first and second external electronic devices 802 and 804 may be a device of which the type is different from or the same as that of the electronic device 801. According to an embodiment of the present disclosure, the server 806 may include a group of one or more servers. According to various embodiments of the present disclosure, all or a part of operations that the electronic device 801 will perform may be executed by another or plural electronic devices (e.g., the electronic devices 802 and 804 and the server 806). According to an embodiment of the present disclosure, in the case where the electronic device 801 executes any function or service automatically or in response to a request, the electronic device 801 may not perform the function or the service internally, but, alternatively additionally, it may request at least a portion of a function associated with the electronic device 801 at other device (e.g., the electronic device 802 or 804 or the server 806). The other electronic device (e.g., the electronic device 802 or 804 or the server 806) may execute the requested function or additional function and may transmit the execution result to the electronic device 801. The electronic device 801 may provide the requested function or service using the received result or may additionally process the received result to provide the requested function or service. To this end, for example, cloud computing, distributed computing, or client-server computing may be used.

The sound output module 880 may be mounted on a housing or a circuit board in the electronic device 801. The sound output module 880 may receive an electric signal from an internal circuit of the electronic device 801 to output a sound. For example, the sound output module 880 may convert an electric signal into physical vibration of a diaphragm.

Figure 9:
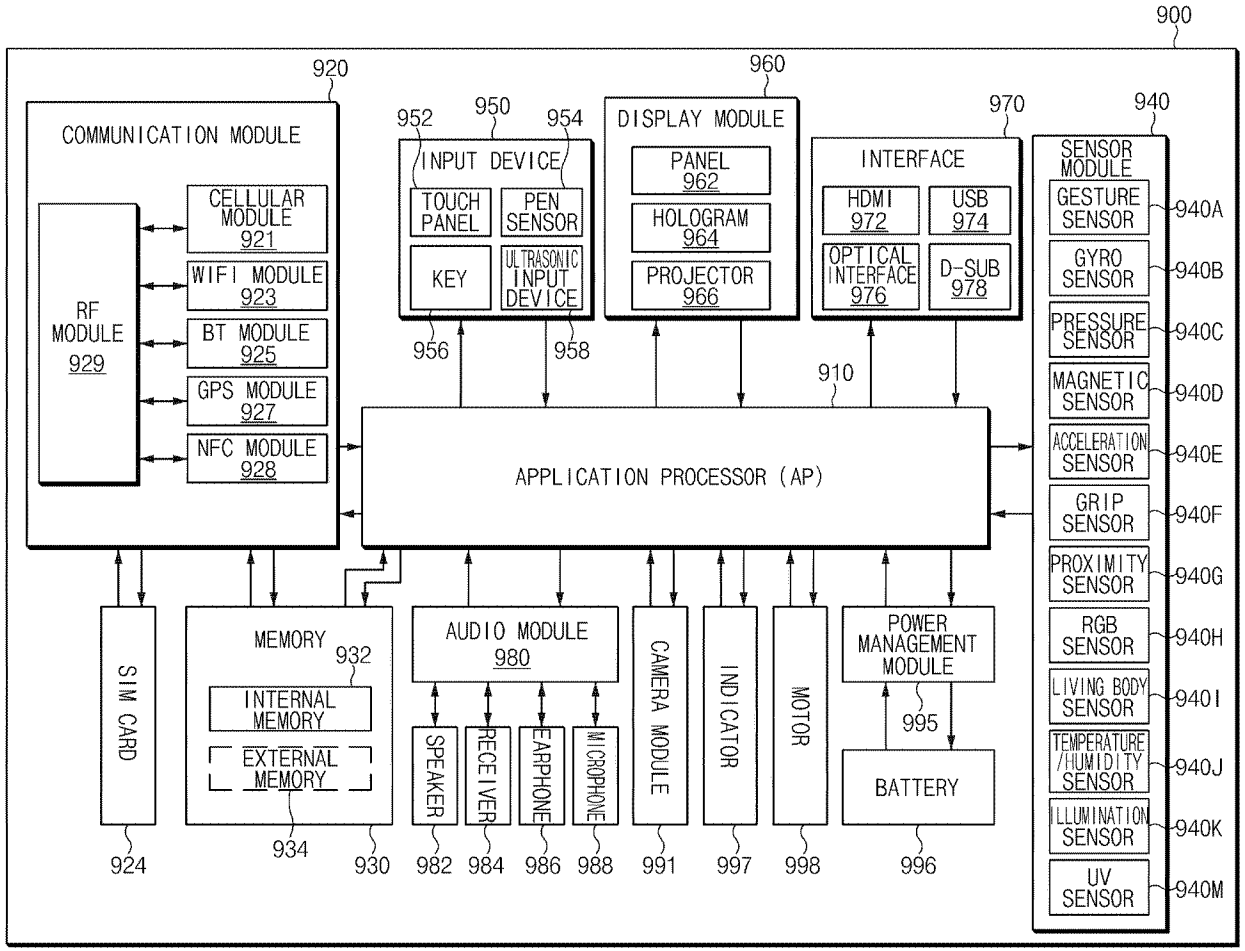
FIG. 9 is a block diagram illustrating an electronic device according to various embodiments of the present disclosure.

FIG. 9 is a block diagram illustrating an electronic device 901 according to various embodiments of the present disclosure.

Referring to FIG. 9, an electronic device 901 may include, for example, all or a part of an electronic device 801 illustrated in FIG. 8. The electronic device 901 may include one or more application processors (AP) 910, a communication module 920, a subscriber identification module 924, a memory 930, a sensor module 940, an input device 950, a display 960, an interface 970, an audio module 980, a camera module 991, a power management module 995, a battery 996, an indicator 997, and a motor 998.

The AP 910 may drive an operating system (OS) or an application to control a plurality of hardware or software components connected to the AP 910 and may process and compute a variety of data. The AP 910 may be implemented with a System on Chip (SoC), for example. According to an embodiment of the present disclosure, the AP 910 may further include a graphic processing unit (GPU) and/or an image signal processor. The AP 910 may include at least a part (e.g., a cellular module 921) of components illustrated in FIG. 9. The AP 910 may load and process an instruction or data, which is received from at least one of other components (e.g., a nonvolatile memory), and may store a variety of data at a nonvolatile memory.

The communication module 920 may be configured the same as or similar to a communication interface 870 of FIG. 8. The communication module 920 may include a cellular module 921, a wireless-fidelity (Wi-Fi) module 923, a Bluetooth (BT) module 925, a global positioning system (GPS) module 927, a near field communication (NFC) module 928, and a radio frequency (RF) module 929.

The cellular module 921 may provide voice communication, video communication, a character service, an Internet service or the like through a communication network. According to an embodiment of the present disclosure, the cellular module 921 may perform discrimination and authentication of an electronic device 901 within a communication network using a subscriber identification module 924 (e.g., the subscriber identification module 924), for example. According to an embodiment of the present disclosure, the cellular module 921 may perform at least a portion of functions that the AP 910 provides. According to an embodiment of the present disclosure, the cellular module 921 may include a communication processor (CP).

Each of the Wi-Fi module 923, the BT module 925, the GPS module 927, and the NFC module 928 may include a processor for processing data exchanged through a corresponding module, for example. According to an embodiment of the present disclosure, at least a portion (e.g., two or more components) of the cellular module 921, the Wi-Fi module 923, the BT module 925, the GPS module 927, and the NFC module 928 may be included within one Integrated Circuit (IC) or an IC package.

The RF module 929 may transmit and receive a communication signal (e.g., an RF signal). The RF module 929 may include a transceiver, a power amplifier module (PAM), a frequency filter, a low noise amplifier (LNA), an antenna, or the like. According to various embodiments of the present disclosure, at least one of the cellular module 921, the Wi-Fi module 923, the BT module 925, the GPS module 927, or the NFC module 928 may transmit and receive an RF signal through a separate RF module.

The subscriber identification module 924 may include, for example, a subscriber identification module and may include unique identify information (e.g., integrated circuit card identifier (ICCID)) or subscriber information (e.g., integrated mobile subscriber identity (IMSI)).

The memory 930 (e.g., the memory 830) may include an embedded memory (or an internal memory) 932 or an external memory 934. For example, the internal memory 932 may include at least one of a volatile memory (e.g., a dynamic random access memory (DRAM), a static RAM (SRAM), or a synchronous DRAM (SDRAM)), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a NAND flash memory, or a NOR flash memory), a hard drive, or a solid state drive (SSD).

The external memory 934 may include a flash drive, for example, compact flash (CF), secure digital (SD), micro secure digital (Micro-SD), mini secure digital (Mini-SD), extreme digital (xD), multimedia card (MMC), a memory stick, or the like. The external memory 934 may be functionally and/or physically connected to the electronic device 901 through various interfaces.

The sensor module 940 may measure, for example, a physical quantity or may detect an operation state of the electronic device 901. The sensor module 940 may convert the measured or detected information to an electric signal. The sensor module 940 may include at least one of a gesture sensor 940A, a gyro sensor 940B, a pressure sensor 940C, a magnetic sensor 940D, an acceleration sensor 940E, a grip sensor 940F, a proximity sensor 940G, a color sensor 940H (e.g., red, green, blue (RGB) sensor), a living body sensor 940I, a temperature/humidity sensor 940J, an illuminance sensor 940K, or an UV sensor 940M. Although not illustrated, additionally or generally, the sensor module 940 may further include, for example, an E-nose sensor, an electromyography sensor (EMG) sensor, an electroencephalogram (EEG) sensor, an electrocardiogram (ECG) sensor, a photoplethysmographic (PPG) sensor, an infrared (IR) sensor, an iris sensor, and/or a fingerprint sensor. The sensor module 940 may further include a control circuit for controlling at least one or more sensors included therein. According to an embodiment of the present disclosure, the electronic device 901 may further include a processor which is a part of the AP 910 or independent of the AP 910 and is configured to control the sensor module 940. The processor may control the sensor module 940 while the AP 910 remains at a sleep state.

The input device 950 may include, for example, a touch panel 952, a (digital) pen sensor 954, a key 956, or an ultrasonic input unit 958. The touch panel 952 may use at least one of capacitive, resistive, infrared and ultrasonic detecting methods. Also, the touch panel 952 may further include a control circuit. The touch panel 952 may further include a tactile layer to provide a tactile reaction to a user.

The (digital) pen sensor 954 may be, for example, a part of a touch panel or may include an additional sheet for recognition. The key 956 may include, for example, a physical button, an optical key, a keypad, and the like. The ultrasonic input device 958 may detect (or sense) an ultrasonic signal, which is generated from an input device, through a microphone (e.g., a microphone 988) and may check data corresponding to the detected ultrasonic signal.

The display 960 (e.g., the input/output interface 850) may include a panel 962, a hologram device 964, or a projector 966. The panel 962 may be configured the same as or similar to the input/output interface 850 of FIG. 8. The panel 962 and the touch panel 952 may be integrated into a single module. The hologram device 964 may display a stereoscopic image in a space using a light interference phenomenon. The projector 966 may project light onto a screen so as to display an image. The screen may be arranged in the inside or the outside of the electronic device 901. According to an embodiment of the present disclosure, the display 960 may further include a control circuit for controlling the panel 962, the hologram device 964, or the projector 966.

The interface 970 may include, for example, an HDMI (high-definition multimedia interface) 972, a USB (universal serial bus) 974, an optical interface 976, or a D-sub (D-subminiature) 978. The interface 970 may be included, for example, in a communication interface 860 illustrated in FIG. 8. Additionally or generally, the interface 970 may include, for example, a mobile high definition link (MHL) interface, a SD card/multimedia card (MMC) interface, or an infrared data association (IrDA) standard interface.

The audio module 980 may convert a sound and an electric signal in dual directions. At least a portion of the audio module 980 may be included, for example, in the input/output interface 850 illustrated in FIG. 8. The audio module 980 may process, for example, sound information that is input or output through a speaker 982, a receiver 984, an earphone 986, or a microphone 988.

The camera module 991 for shooting a still image or a video may include, for example, at least one image sensor (e.g., a front sensor or a rear sensor), a lens, an image signal processor (ISP), or a flash (e.g., an LED or a xenon lamp).

The power management module 995 may manage, for example, power of the electronic device 901. According to an embodiment of the present disclosure, a power management integrated circuit (PMIC) a charger IC, or a battery or fuel gauge may be included in the power management module 995. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 996 and a voltage, current or temperature thereof while the battery is charged. The battery 996 may include, for example, a rechargeable battery or a solar battery.

The indicator 997 may display a specific state of the electronic device 901 or a portion thereof (e.g., an AP 910), such as a booting state, a message state, a charging state, and the like. The motor 998 may convert an electrical signal into a mechanical vibration and may generate the following effects: vibration, haptic, and the like. Although not illustrated, a processing device (e.g., a GPU) for supporting a mobile TV may be included in the electronic device 901. The processing device for supporting a mobile TV may process media data according to the standards of DMB, digital video broadcasting (DVB), MediaFlo™, or the like.

Each of the above-mentioned elements of the electronic device according to various embodiments of the present disclosure may be configured with one or more components, and the names of the elements may be changed according to the type of the electronic device. The electronic device according to various embodiments of the present disclosure may include at least one of the above-mentioned elements, and some elements may be omitted or other additional elements may be added. Furthermore, some of the elements of the electronic device according to various embodiments of the present disclosure may be combined with each other so as to form one entity, so that the functions of the elements may be performed in the same manner as before the combination.

The terms "unit" or "module" referred to herein is to be understood as comprising hardware such as a processor or microprocessor configured for a certain desired functionality, or a non-transitory medium comprising machine executable code, in accordance with statutory subject matter under 35 U.S.C. § 101 and does not constitute software per se. The term "module" may be interchangeably used with the terms "unit," "logic," "logical block," "component" and "circuit." The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

At least a portion of an apparatus (e.g., modules or functions thereof) or a method (e.g., operations) according to various embodiments of the present disclosure may be, for example, implemented by instructions stored in a computer-readable storage media in the form of a program module. The instruction, when executed by one or more processors (e.g., a processor 210), may cause the one or more processors to perform a function corresponding to the instruction. The computer-readable storage media, for example, may be the memory 230.

A computer-readable recording medium may include a hard disk, a magnetic media, a floppy disk, a magnetic media (e.g., a magnetic tape), an optical media (e.g., a compact disc read only memory (CD-ROM) and a digital versatile disc (DVD), a magneto-optical media (e.g., a floptical disk), and hardware devices (e.g., a read only memory (ROM), a random access memory (RAM), or a flash memory). Also, a program instruction may include not only a mechanical code such as things generated by a compiler but also a high-level language code executable on a computer using an interpreter. The above hardware unit may be configured to operate via one or more software modules for performing an operation of the present disclosure, and vice versa.

A module or a program module according to various embodiments of the present disclosure may include at least one of the above elements, or a portion of the above elements may be omitted, or additional other elements may be further included. Operations performed by a module, a program module, or other elements according to various embodiments of the present disclosure may be executed sequentially, in parallel, repeatedly, or in a heuristic method. Also, a portion of operations may be executed in different sequences, omitted, or other operations may be added.

The above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, or a combination hardware configured with machine executable code and may be performed in whole or in part within the programmed instructions of a computer. No claim element herein is to be construed under the provisions of 35 U.S.C. 112, sixth paragraph, unless the element is expressly recited using the phrase "means for."

In addition, an artisan understands and appreciates that a "processor" or "microprocessor" constitute hardware in the claimed invention. Under the broadest reasonable interpretation, the appended claims constitute statutory subject matter in compliance with 35 U.S.C. § 101.

According to various embodiments of the present disclosure, it may be possible to miniaturize an electronic device without lowering of a sound output and to improve the sound output of the electronic device.

According to various embodiments of the present disclosure, an electronic device may efficiently emit heat, which is generated according to an operation of a micro speaker, to the outside, thereby improving the durability of the electronic device.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A micro speaker comprising:

a diaphragm;

one coil coupled with the diaphragm;

a magnet configured to interact with a magnetic field induced by the coil; and a yoke plate, disposed on a bottom of the magnet, including one center portion and two end portions and one hole, the hole being formed between one of the two end portions and the center portion of the yoke plate, wherein an area, adjacent to the hole, of a lower surface of the yoke plate has a height difference relative to another area of the lower surface of the yoke plate, wherein the hole is disposed aligned with a center of the coil and extends through the center portion and the one of the two end portions of the yoke plate.

2. The micro speaker of claim 1, wherein the yoke plate has a first thickness at a first area adjacent to the hole and has a second thickness, thicker than the first thickness, at a second area.

3. The micro speaker of claim 1, wherein the lower surface of the yoke plate comprises:

a first area having a first thickness and adjacent to the hole;

a second area having a second thickness thicker than the first thickness; and a third area between the first area and the second area having a third thickness no less than the first thickness and no greater than the second thickness.

4. The micro speaker of claim 3, wherein the third thickness of one portion of the third area is different from the third thickness of another portion of the third area.

5. The micro speaker of claim 3, wherein the third thickness of one portion of the third area is equal to the first thickness of the first area or the third thickness of another portion of the third area is equal to the second thickness of the second area.

* * * * *